US007267480B1

(12) United States Patent
Hasson

(10) Patent No.: US 7,267,480 B1
(45) Date of Patent: Sep. 11, 2007

(54) SCRAPBOOK CLOCK

(75) Inventor: Todd M. Hasson, Beverly Hills, CA (US)

(73) Assignee: Innovation Specialties, Inc., Culver City, CA (US)

( * ) Notice: Subject to any disclaimer, the term of this patent is extended or adjusted under 35 U.S.C. 154(b) by 81 days.

(21) Appl. No.: 11/303,648

(22) Filed: Dec. 16, 2005

(51) Int. Cl.
*G04B 19/04* (2006.01)

(52) U.S. Cl. ..... 368/286; 368/228

(58) Field of Classification Search ..... 368/286, 368/338, 76, 80, 223, 276
See application file for complete search history.

(56) References Cited

U.S. PATENT DOCUMENTS 3,595,009 A * 7/1971 Pakter et al. ..... 368/80
3,715,882 A * 2/1973 Ohde ..... 368/276
4,506,993 A * 3/1985 Brown ..... 368/314
5,018,118 A * 5/1991 Ross ..... 368/228
5,142,512 A * 8/1992 Takano et al. ..... 368/232
5,375,102 A * 12/1994 Schiavolini ..... 368/10
5,787,055 A * 7/1998 Alpert ..... 368/223
6,278,664 B1 * 8/2001 Huffman et al. ..... 368/223
6,942,379 B2 * 9/2005 Hardy ..... 368/276
7,196,974 B2 * 3/2007 Yang et al. ..... 368/228
2003/0210613 A1 * 11/2003 Bloch ..... 368/223
2004/0001391 A1 * 1/2004 Gilbert ..... 368/223

* cited by examiner

*Primary Examiner*—Gary F. Paumen
(74) *Attorney, Agent, or Firm*—Thomas I. Rozsa

(57) ABSTRACT

The present invention is a method and apparatus for decorating the dial of a clock with photos, papers, or other embellishments so as to create a decorative personalized memory for the person's home or office through the creation of a specific customized timepiece incorporating memorabilia from the personal special event. The invention incorporates the use of a blank clock dial with hour numbers printed on it and adhering decorative paper memorabilia to the clock face. The invention also includes the use of a distinctive pair of clock hands to set it apart from the decorative items adhered to the clock face.

14 Claims, 5 Drawing Sheets

SCRAPBOOK CLOCK

BACKGROUND OF THE INVENTION

1. Field of the Invention

The present invention relates to the field of home and office decoration items which includes decorations made of personal memorabilia. The present invention also relates to the field of decorative wall clocks.

2. Description of the Prior Art

In general, the concept of decorative wall clocks has been known in the prior art. The concept of maintaining a scrapbook of personal events such as a wedding, the birth of a baby, an anniversary, and recording memories of other personal events is also well known in the prior art. However, to the best of the present inventor's knowledge, no one has ever conceived of the concept of incorporating the recordation of special personal events on the face of a clock so that the person has a permanent record of the special event combined with a utilitarian object that is used every day and which will serve as a pleasant reminder of the cherished personal event.

SUMMARY OF THE INVENTION

The present invention is a method and apparatus for decorating the dial of a clock with photos, papers, or other embellishments so as to create a decorative personalized memory for the person's home or office through the creation of a specific customized timepiece incorporating memorabilia from the personal special event. The invention incorporates the use of a blank clock dial with hour numbers printed on it and adhering decorative paper memorabilia to the clock face. The invention also includes the use of a distinctive pair of clock hands to set it apart from the decorative items adhered to the clock face.

It has been discovered, according to the present invention, that a wall clock dial is a perfect surface to decorate with photos, papers, embellishments and memories while at the same time offering function to the home or office decor. For every special person or event that one desires to commemorate with a scrapbook page, a corresponding custom clock to match can also be created.

It has also been discovered, according to the present invention, that all parts of a clock such as the dial, the lens, and the bezel can be specially decorated to customize the clock to commemorate a special person, event or other fond and cherished memory of the creator.

It has further been discovered, according to the present invention, that an ideal scrapbook clock kit comprises at least one plastic case or bezel, at least one clear plastic lens, a clock movement, at least two sets of clock hands (one black and one white so the appropriate color to match the customized artwork can be selected) and at least one white clock dial or preferably a multiplicity of clock dials with different clock numbers in arabic or roman numerals.

It has additionally been discovered, according to the present invention, that the scrapbook clock kit can be designed to be a wall clock or a table clock and although round is the preferred shape, any shape including but not limited to square, rectangular, oval, pentagonal hexagonal or octagonal is within the spirit and scope of the present invention.

It is therefore an object of the present invention to provide a wall clock dial which can be used as a surface to decorate with photos, papers, embellishments and memories to create a customized memorabilia object while at the same time offering function to the home or office decor. It is therefore the object of the present invention that for every special person or event that one desires to commemorate with a scrapbook page, a corresponding custom clock to match can also be created.

It is also an object of the present invention to provide a kit wherein all parts of a clock such as the dial, the lens, and the bezel can be specially decorated to customize the clock to commemorate a special person, event or other fond and cherished memory of the creator.

It is a further object of the present invention to provide an ideal scrapbook clock kit for creating any desired customized memorabilia clock which comprises at least one plastic case or bezel, at least one clear plastic lens, a clock movement, at least two sets of clock hands (one black and one white so the appropriate color to match the customized artwork can be selected) and at least one white clock dial or preferably a multiplicity of clock dials with different clock numbers in arabic or roman numerals.

It is an additional object of the present invention to provide a scrapbook clock kit which can be designed to be a wall clock or a table clock and although round is the preferred shape, any shape including but not limited to square, rectangular, oval, pentagonal hexagonal or octagonal is within the spirit and scope of the present invention.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
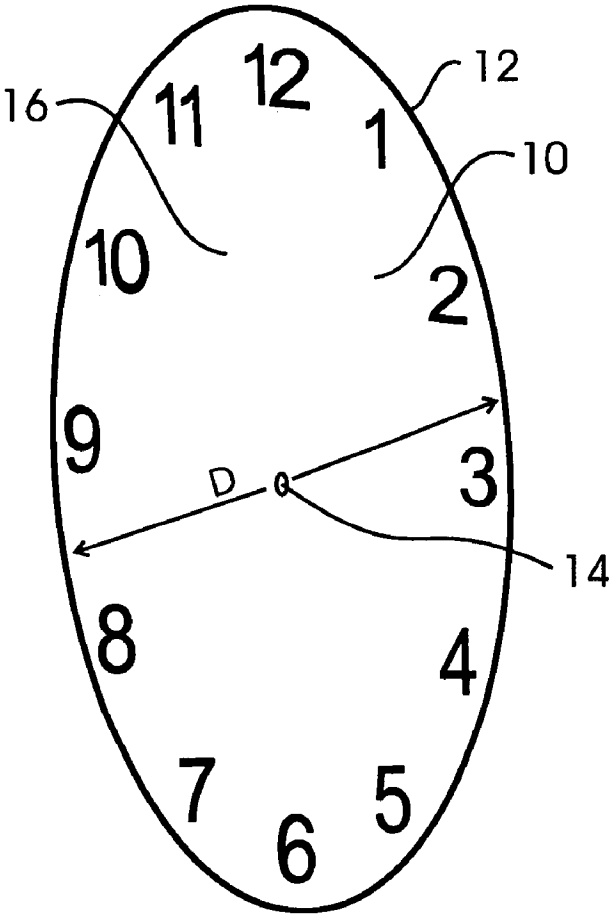
FIG. 1 is a perspective view of a clock dial of the present invention scrapbook clock kit.

Referring to FIG. 1, the present invention scrapbook clock comes with at least one a blank clock dial 10 which is preferably made of card stock paper to be used as the base on which is adhered the decorative background for the clock. Optionally, as illustrated in FIG. 1, the hours of the clock are printed on the blank clock dial.

The clock dial 10 is used as a pattern to cut out the paper for the background of the clock. By way of example, the blank clock dial can be round and have a diameter "D" of 12 inches.

Figure 2:
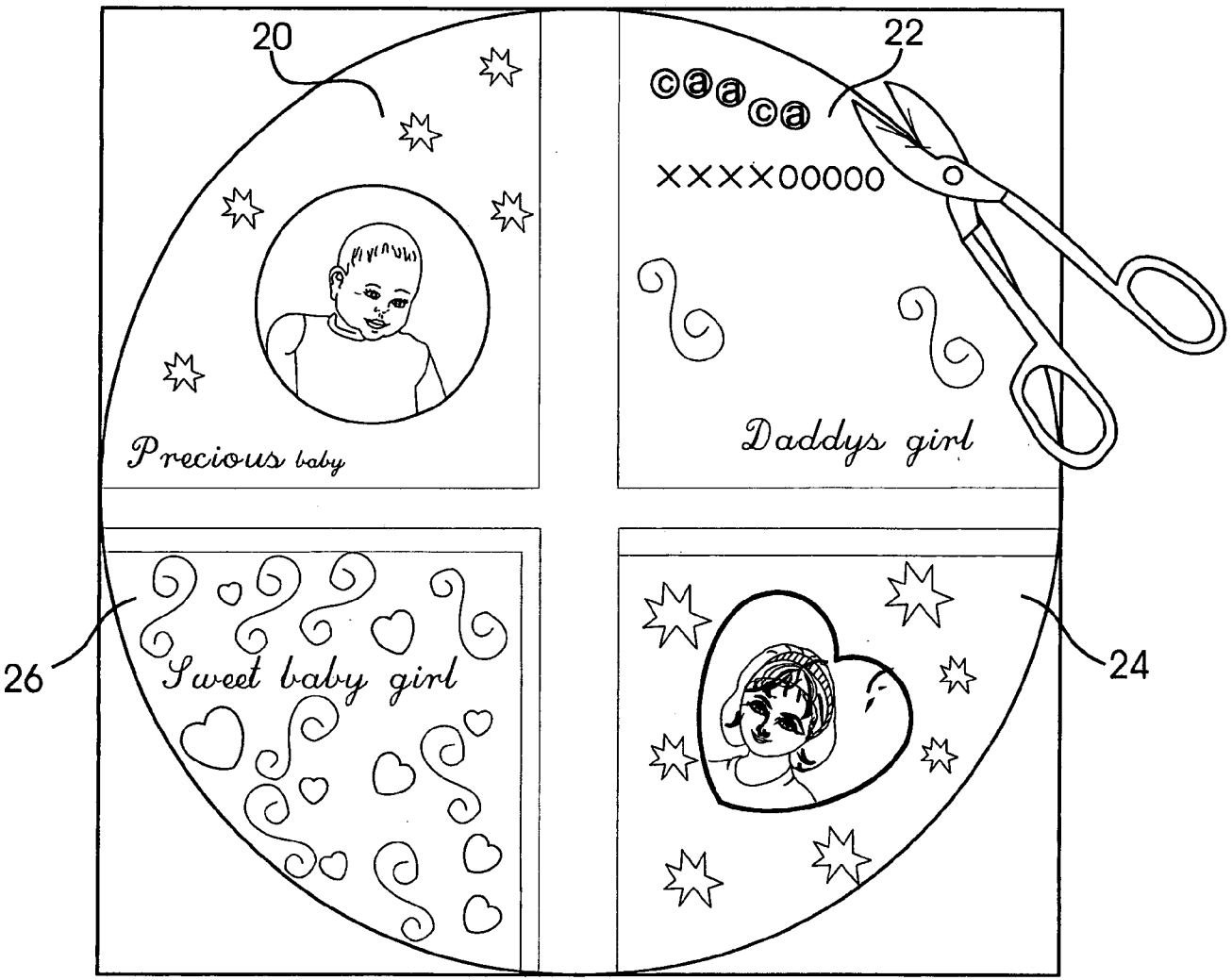
FIG. 2 is a copy of decorative artwork scrapbook designs or photographs to be used for the dial of the scrapbook clock.

Referring to FIG. 2, there is illustrated the personal memorabilia scrapbook designs which also can be photographs, 20, 22, 24, and 26. The scrapbook designs are cut out and adhered to the clock dial 10 and the scrapbook paper designs 20, 22, 24 and 26 can be cut using the circumference 12 of the blank clock dial 10 as a cutting pattern.

To attach paper to the clock and scrapbook photos or other memorabilia to the paper, adhesives designed for paper crafts should be used in order to prevent the paper from buckling. Glue dots, brads and glues for dimensional items can be used for embellishments. Alternatively, glue sticks, double sided adhesives and paper corners can be used to attach photos to the clock dial. When attaching velum, it is important to either use adhesive designed ro velum or glue. If there are areas where the glue may show through, then those areas should be covered with an embellishment or photo.

Rather than using original photos, it is preferred that photocopies be used on the clock face. Copies of photos made through color copies, printers or reprints of photos should be used. Clip art, stamped images, drawings, etc. may be used as well.

Figure 3:
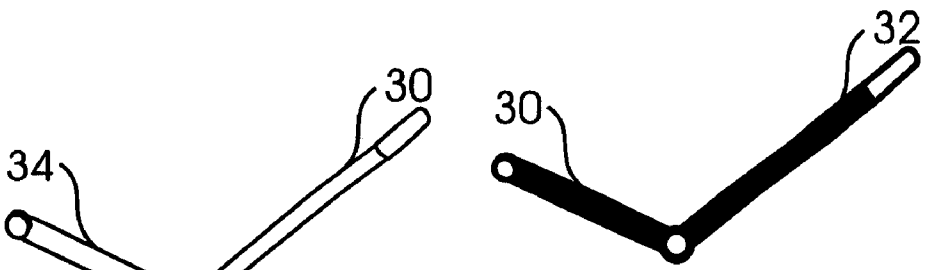
FIG. 3 is a perspective view of two sets of clock hands.

Referring to FIG. 3, several alternative sets of clock hands are provided so that the clock hands stand out from the scrapbook background on the clock dial so that the hands can be easily seen. Since it is desirable to be able to read time easily, dark clock hands 30 and 32 should be used for light clock dial background and light clock hands 34 and 36 should be used for dark clock dial backgrounds. If the background on the clock dial is too dark to be able to see the hands clearly or if the scrapbook background is too busy, then a sheet of velum 40 cut to the shape of the clock dial should be placed over the patterned images so as to mute the colors in order for the clock hands to be more easily seen.

To keep accurate time, it is important to not allow any elements to come in contact with the clock hands once the clock is assembled. Embellishments such as layers of photos, ribbons, stickers, or rubber stamped images can be used for the background on the clock dial as long as they are not in the way of the clock hands. Thicker embellishments can be placed on the outer area of the clock dial where they will not interfere with the clock hands.

For the center hole 14 which will support the clock hands, it is important to cut through all layers of the clock dial 10 and added embellishment using a craft knife or sharp, detail scissors to cut the center hole for the clock movement and shaft.

Figure 4:
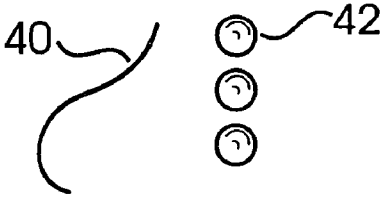
FIG. 4 is a perspective view of yarn and beads to be placed on the clock hands.

Weighted elements should not be attached to the clock hands because they may cause the clock to keep inaccurate time. Referring to FIG. 4, if further embellishment to the clock hands is desired, light elements such as small amounts of yarn or thread 40 or a mini sticker or bead 42 can be attached to decorate the clock hands. If desired, the clock hands can be colored to any color using a paint for plastic or a metallic paste.

Figure 5:
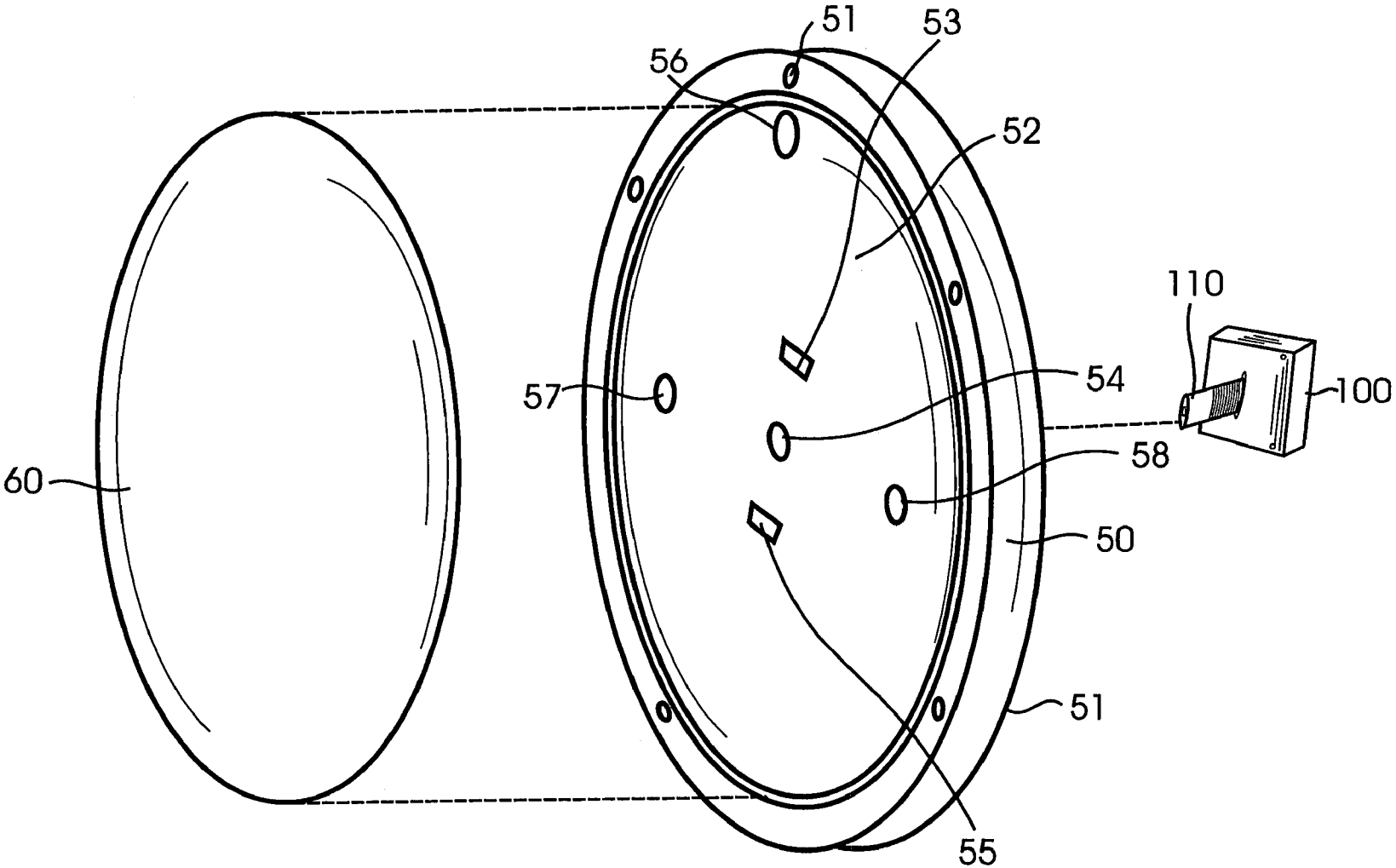
FIG. 5 is an exploded perspective view of the clock bezel and lens of the present invention scrapbook clock and the clock motor.

Referring to FIG. 5, the frame for the clock which can be a clear plastic case is called a bezel 50. The bezel has a backplate 52 supported within the bezel 50. The backplate has a cental opening 54 and slotted openings 53 and 55 respectively positioned above and below the cental opening 54. A conventional clock motor 100 is affixed to the backplate 52 at the location of the slotted openings 53 and 55 and the cental shaft or rotor 110 which supports the clock hands fits through opening 54. The clock may be hung by a nail or picture frame hook placed through top opening 56. Side openings 57 and 58 can be used to further secure the clock to a wall or to a stand if the clock is to be a table clock instead of a wall clock.

Figure 6:
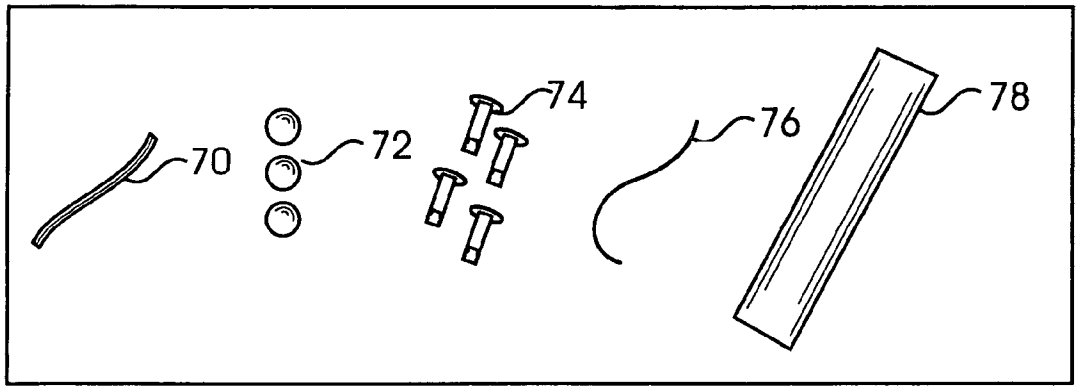
FIG. 6 is a perspective view of decorative embellishments to be placed on the clock bezel.

The clear cover surrounded by the bezel is called the lens 60. The lens is removably affixed to the bezel so that the decorated dial can be placed into the bezel and thereafter the hands affixed to the rotor from the clock motor and hereafter the lens covers the decorated dial. Both the bezel 50 and the lens 60 can be further decorated to further personalize the scrapbook clock. Referring to FIG. 6, there are illustrated embellishments such as wires 70, beads 72, brads 74, yarn 76, and ribbon 78. The bezel can be drilled with small holes 51 to attach embellishments such as wires 70, beads 72, brads 74, yarn 76, and ribbon 78. It is important that the holes be sufficiently spaced apart so as not to make the bezel unstable. There also should not be too many holes which would also make the bezel unstable.

Figure 7:
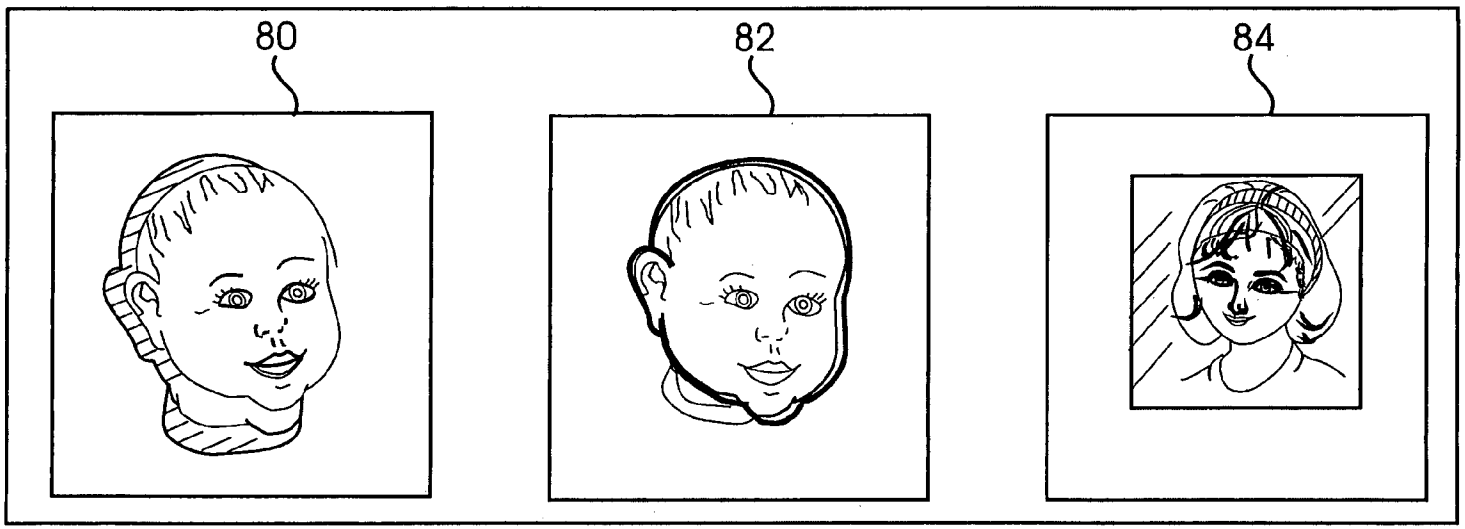
FIG. 7 is a perspective view of embellishments to be placed on the clock lens.

The lens 60 can also be decorated to match the design. Referring to FIG. 7, a rub-on stencil or decal 80, stamped images 82, stickers 84, etc. can be placed or adhered to the lens 60. It is important that the images placed on the lens be positioned so as not to interfere with the clock hands.

Figure 8:
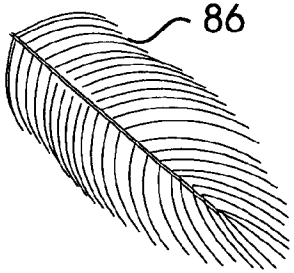
FIG. 8 is a perspective view of a hanging ornament to be placed on the back of the clock bezel.

It is also possible to place hanging embellishments onto the clock. Referring to FIG. 8, one type of hanging embellishment such as a feather 86 is illustrated. Preferably, such hanging embellishment should be placed behind the clock to hang below the clock. The hanging embellishment should not be weighted by an amount which would make the clock unstable.

Figure 9:
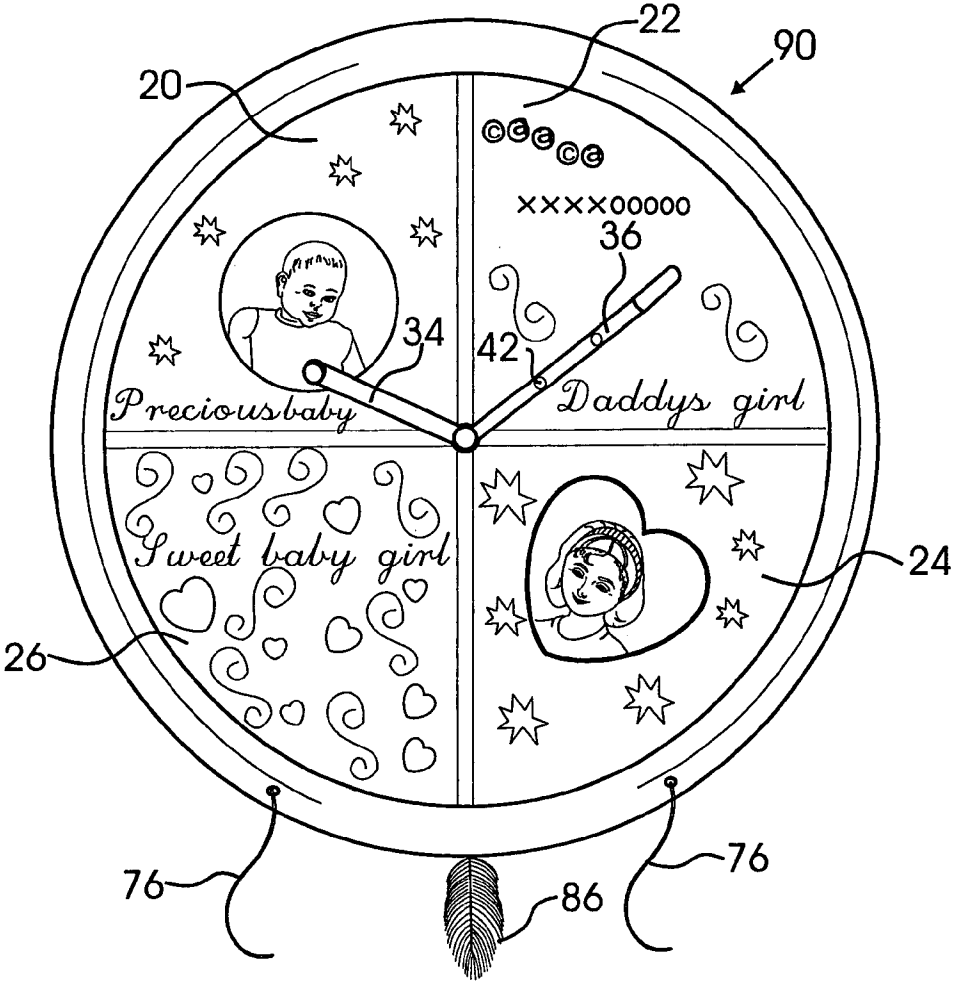
FIG. 9 is a perspective view of a completed scrapbook clock.

Referring to FIG. 9, there is illustrated the completed scrapbook clock 90 with the scrapbook images 20, 22, 24 and 26 cut to fit on the face 16 of clock dial 10 with the clock hands 34 and 36 clearly distinguishable from the background scrapbook images. The clock hands 34 and 36 have a decorative bead 42 thereon. The bezel has a yarn decoration 76 thereon. A back decoration feather 86 is affixed to the back of the bezel 50.

Defined in detail, the present invention is a kit for making a decorative clock, comprising: (a) a bezel having a backplate having means through which a clock motor is retained and a central opening through which the clock motor's rotor which supports a pair of clock hands extends through the backplate; (b) a removable lens which is retained within the bezel; (c) a clock dial which has a face onto which decorations are placed and a central opening to receive the rotor; (d) a pair of clock hands placed onto the rotor; (e) means by which the clock can be hung from the vertical surface or mounted on a base; and (f) instructions by which personal memorabilia are adhered to the clock dial which is then placed into and retained within the bezel, the clock hands are placed onto the rotor, and the lens is placed into the bezel to cover the decorated dial.

Defined more broadly, is the present invention is an unassembled kit for a time clock, comprising: (a) a clear plastic case; (b) a clear plastic lens; (c) a clock movement; (d) at least one set of clock hands; (e) at least one clock dial which has a surface onto which personal memorabilia can be affixed; and (f) instructions by which personal memorabilia are adhered to the clock dial which is then placed into and retained within the clear plastic case, the clock hands are placed onto the clock movement, and the lens is placed into the clear plastic case.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A kit for making a decorative clock, comprising:

a. a bezel having a backplate having means through which a clock motor is retained and a central opening through which the clock motor's rotor which supports a pair of clock hands extends through the backplate;

b. a removable lens which is retained within the bezel;

c. a clock dial which has a face onto which decorations are placed and a central opening to receive the rotor;

d. a pair of clock hands placed onto the rotor;

e. means by which the clock can be hung from the vertical surface or mounted on a base; and e. instructions by which personal memorabilia are adhered to the clock dial which is then placed into and retained within the bezel, the clock hands are placed onto the rotor, and the lens is placed into the bezel to cover the decorated dial.

2. The clock in accordance with claim 1 wherein the instructions provide for further decorations to be placed on the bezel.

3. The clock in accordance with claim 1 wherein the instructions provide for further decorations to be placed on the lens.

4. The clock in accordance with claim 1 wherein the instructions provide for further decorations to be placed on the clock hands.

5. The clock in accordance with claim 1 wherein the instructions provide for further decorations to be placed on the back to the bezel.

6. The clock in accordance with claim 1 wherein the shape of the bezel, lens, and clock dial are all the same shape, the shape selected from the group comprising round, oval, square, rectangular, pentagonal, hexagonal and octagonal.

7. An unassembled kit for a time clock, comprising:

a. a clear plastic case;

b. a clear plastic lens;

c. a clock movement;

d. at least one set of clock hands;

e. at least one clock dial which has a surface onto which personal memorabilia can be affixed; and f. instructions by which personal memorabilia are adhered to the clock dial which is then placed into and retained within the clear plastic case, the clock hands are placed onto the clock movement, and the lens is placed into the clear plastic case.

8. The kit in accordance with claim 7 further comprising two sets of clock hands, one set having a dark color and one set having a light color.

9. The kit in accordance with claim 7, further comprising a multiplicity of different dials.

10. The kit in accordance with claim 7, wherein the instructions provide for further decorations to be placed on the plastic case.

11. The clock in accordance with claim 7, wherein the instructions provide for further decorations to be placed on the lens.

12. The clock in accordance with claim 7 wherein the instructions provide for further decorations to be placed on the clock hands.

13. The clock in accordance with claim 7, wherein the instructions provide for further decorations to be placed on the back of the plastic case.

14. The clock in accordance with claim 7, wherein the shape of the plastic case, lens, and clock dial are all the same shape, the shape selected from the group comprising round, oval, square, rectangular, pentagonal, hexagonal and octagonal.

* * * * *